US010231494B2

(12) United States Patent
Shapiro et al.

(10) Patent No.: US 10,231,494 B2
(45) Date of Patent: Mar. 19, 2019

(54) GARMENT WITH LOCALIZED CIRCULATION BOOSTING FEATURE

(71) Applicant: EVOGENERATE, LLC, New York, NY (US)

(72) Inventors: Holly Shapiro, New York, NY (US); John Koetz, New York, NY (US)

(73) Assignee: EVOGENERATE, LLC, New York, NY (US)

( * ) Notice: Subject to any disclaimer, the term of this patent is extended or adjusted under 35 U.S.C. 154(b) by 52 days.

(21) Appl. No.: 15/373,557

(22) Filed: Dec. 9, 2016

(65) Prior Publication Data

US 2018/0160745 A1 Jun. 14, 2018

(51) Int. Cl.

| | |
|---|---|
| ***A41D 13/00*** | (2006.01) |
| ***A41D 13/002*** | (2006.01) |
| *A41D 31/00* | (2019.01) |
| *A41D 13/12* | (2006.01) |

(52) U.S. Cl.

CPC ..... *A41D 13/002* (2013.01); *A41D 13/1236* (2013.01); *A41D 31/0038* (2013.01); *A41D 2400/10* (2013.01); *A41D 2400/32* (2013.01)

(58) Field of Classification Search

CPC ... A41B 1/08; A41D 1/04; A41D 1/08; A41D 3/00; A41D 13/0015; A41D 31/0016; A41D 2200/20; A41D 2400/10

USPC ..... 2/115

See application file for complete search history.

(56) References Cited

U.S. PATENT DOCUMENTS 2,391,535 A * 12/1945 Zelano ..... A41D 27/28 2/227
2,464,380 A * 3/1949 Daiber ..... A41D 27/06 2/458
4,625,336 A 12/1986 Derderian
5,469,581 A * 11/1995 Uthoff ..... A41D 13/0015 2/115
5,792,714 A * 8/1998 Schindler ..... A41B 11/00 2/69
6,109,338 A * 8/2000 Butzer ..... A41D 13/005 165/46
6,332,221 B1 * 12/2001 Gracey ..... A41B 9/00 2/108
7,743,476 B2 * 6/2010 Rock ..... D04B 1/02 2/69
8,856,964 B2 * 10/2014 Mather ..... A41D 1/04 2/115

(Continued)

*Primary Examiner* — Richale Quinn
*Assistant Examiner* — Anne Kozak
(74) *Attorney, Agent, or Firm* — Notaro, Michalos & Zaccaria P.C.

(57) ABSTRACT

A garment for boosting circulation in areas of a user's body corresponding to the user's joints, having at least one fabric member of a size for at least partly covering at least one part of the user's body that includes at least one joint area lying over at least one joint of the user, and at least one muscle area lying over at least one muscle of the user, the fabric member being at least one of dimensioned and structured so as not to compress the part of the user's body covered by the fabric member, the fabric member having a heat insulating property at each joint area to be covered and a heat transmitting property at each muscle area to be covered, so that when the garment is worn, each joint area stays warmer than each muscle area to boost circulation in each joint area.

8 Claims, 13 Drawing Sheets

(56) References Cited

U.S. PATENT DOCUMENTS

| | | | | |
|---|---|---|---|---|
| 8,887,315 | B2 * | 11/2014 | Boynton | A61F 5/026 2/24 |
| 9,119,707 | B2 * | 9/2015 | Brown | A61F 5/026 |
| 9,125,442 | B2 * | 9/2015 | Brown | A61F 5/026 |
| 2003/0041364 | A1 * | 3/2003 | Donaldson | A41D 13/1236 2/69 |
| 2003/0061650 | A1 * | 4/2003 | Emanuel | A41B 9/06 2/115 |
| 2005/0086721 | A1 * | 4/2005 | Lambertz | A41D 13/002 2/69 |
| 2005/0204449 | A1 * | 9/2005 | Baron | A41D 1/04 2/69 |
| 2006/0179539 | A1 * | 8/2006 | Harber | A41D 13/002 2/69 |
| 2007/0022510 | A1 * | 2/2007 | Chapuis | A41D 13/0015 2/69 |
| 2008/0289078 | A1 * | 11/2008 | Mather | A41D 1/04 2/85 |
| 2011/0088137 | A1 * | 4/2011 | Ayers | A41D 15/005 2/102 |
| 2012/0174282 | A1 * | 7/2012 | Newton | A41D 13/0015 2/69 |
| 2013/0326785 | A1 * | 12/2013 | Cornacchiari | A41D 1/00 2/69 |
| 2014/0243938 | A1 * | 8/2014 | McPherson | A61F 7/02 607/100 |
| 2015/0196067 | A1 * | 7/2015 | Blakely | A41D 13/0015 2/69 |
| 2016/0120236 | A1 * | 5/2016 | Critelli | A41D 13/0058 2/69 |

* cited by examiner

GARMENT WITH LOCALIZED CIRCULATION BOOSTING FEATURE

FIELD AND BACKGROUND OF THE INVENTION

The present invention relates generally to the field of garments, and, in particular, to a garment that increases blood circulation in selected areas corresponding to a person's joints, by retaining more heat in these areas than in other areas that are also covered by the garment. The garment of the invention may be active wear, specialized clothing to enhancing physical performance and recovery of the body from fatigue or injury, base layer/underwear, outer wear, wetsuit tops, bottoms or combination, or other general or special purpose coverings for parts or all of a person's body. The invention is for men, women and children.

Modern people are experiencing greater wear and tear on joints and muscles than at other times in history. Activities involve greater physical stresses than in the past due to extensive training and overuse for example in sports, marathons, bouts of plyometric exercise, endurance and strength training, and the like. Activities of our ancestors were based on moment-to-moment life sustaining needs. They walked, built, farmed, rested when tired, and only ran when chased by natural predators, for example, by sabertooth tigers. This invention was designed to augment the evolving physical needs and wants of modern people.

As will be explained more fully later in this disclosure, the current invention originates from the realization that heat stimulates vasodilation. The vascular system of the human body is an extensive network of connected blood vessels delivering oxygen and nutrients to the body's tissues and taking away waste (e.g. carbon dioxide/waste product of aerobic respiration and lactic acid/waste product of anaerobic respiration). The circulatory (transport) system is composed of arteries/veins (high volume transport), arterioles/venules (moderate volume), capillaries (low volume). Muscles have a prodigious vascular network that supply nutrients for muscles to contract, build, repair, discard waste-carbon dioxide/lactic acid and generate heat.

Joint capsules of the body's periphery, have a substantially limited vascular network, as a result low volume circulation. The purpose of the invention is to stimulate dilation of the capillary network (increase closer to moderate volume) improving heat/circulation in and around joint capsules of the body's periphery where pathways for circulation are limited (what gloves do for hands in the cold). Increased circulation improves the flow of oxygen and nutrients to the cells and discarding of cellular waste. This effect improves mobility, performance, reduces injury and expedites regeneration (healing/recovery). Injuries related to the overuse of the joint capsule during ambulation are a common occurrence.

The human body is not designed to accommodate the physical wear and tear of modern day physical activities. The invention effectively augments our mechanical and physiological demands.

In FIG. 25 the numerals denote temperature in degrees Celsius. This drawing schematically shows that the temperature and, therefore, the blood circulation of the joint areas are far less effective then in the muscles areas. Garment technology to date has tried to solve this with sleeves and compression garments. The invention disclosed here does not use compression, which actually reduces circulation over time, but rather increases circulation and, in turn, body temperature in specific location of the body, while relaxing and while in exertion states.

SUMMARY OF THE INVENTION

It is an object of the present invention to provide a garment for boosting circulation in areas of a user's body corresponding to the user's joint articulations, comprising one or more connected fabric members that are each of a size for at least partly covering one or more parts of the user's body that include at least one joint area lying over at least one joint and adjacent areas of the user, and at least one muscle area lying over at least one large muscle of the user, each fabric member being either dimensioned or structured so as not to compress that part of the user's body that is encircled by the fabric member, the fabric member having a heat insulating property at each joint area to be covered, and a heat transmitting property at each muscle area to be covered, so that when the garment is worn, each joint area stays warmer than each muscle area, to boost circulation in each joint area, to, in turn, balance the body's use and development.

The structure and placement of the garment of the invention causes temperature increase and improvements in circulation in the joint areas of the user, by strategic placement and internal materials used in the garment and not just by increased body temperature overall, nor by compression that tends to reduce temperature and blood circulation. If FIG. 25 represents a relaxed state with the knee joint about 4.5 degrees Celsius cooler then the large muscle groups, the invention will cause the knee joint to warm to about 29.5 degrees Celsius or warmer, thus increasing circulation and temperature throughout the body but not causing over heating of the muscle areas.

A purpose of the invention is to bring heat/circulation to the areas of the joints and to decease heat in the naturally warmer areas of the muscles, to balance the circulation, protect the body against over heating and improve a user's performance.

The garment or apparel of the invention is comprised of technical fabrics placed in biomechanically calculated and selected locations on the body that correspond within the garment. The design generates heat to stimulate vasodilation in vital regions, i.e., joint articulations areas of the body. Increased heat distribution in and around joints of the periphery improves circulation and efficiency in movement and recovery.

The advantages of the invention result from creating a product that improves performance and recovery based on the physical demands of modern people and augments physical movement, expedites recovery and regeneration for an increasingly active population.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
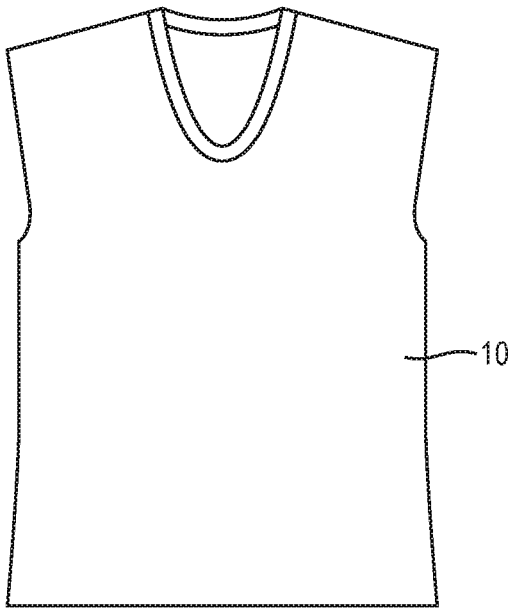
FIG. 1 is a front view of a lady's sleeveless workout or recovery top according to the invention, in a right-side out position, understanding that any fabric can be used on the face of the garment.
Figure 2:
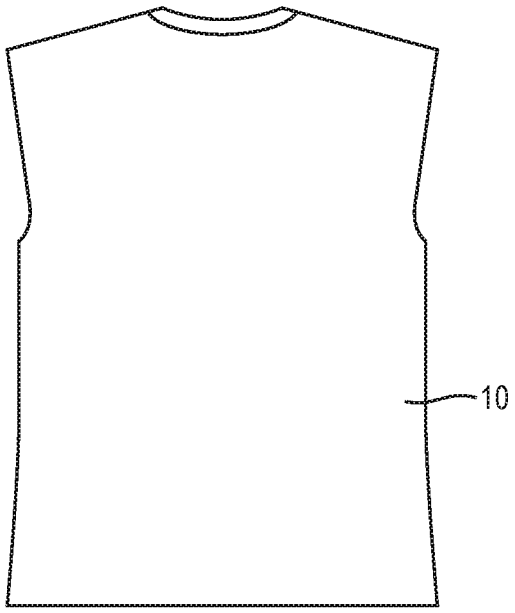
FIG. 2 is a back view of the lady's sleeveless workout or recovery top according to the invention, in the right-side-out position.

Referring now to the drawings, in which like reference numerals are used to refer to the same or similar elements, FIGS. 1 to 4 illustrate one embodiment of the invention in the form of a lady's sleeveless workout and recovery top or garment that boosts circulation in areas of a user's body corresponding to the user's joints. The garment comprises a fabric base member 10 of a size for covering the shoulders and trunk or thorax of the user's body, down to and including the waist area and the high hip area. These areas include what will be called here, joint areas and muscle areas, respectively.

For the workout top of FIGS. 1 to 4, the joint areas include the inner parts of the shoulder ball joints and the joints of the back and waist, namely the joints between the vertebrae of the spinal column from the user's neck to the user's high hip area.

The muscle areas of the user for garments formed as tops, include the upper and lower chest areas at the front, sides and back of the rib cage, on opposite sides of the spinal column.

The garment top comprises a fabric member having the base layer of heat transmitting material like a nylon blend, for example, that lies over and covers the joint areas and the muscle areas of the part of the user's body to be covered by the garment. While this fabric member is either dimensioned or structured or both, in a way that does not compress the parts of the user's body covered or encircled by this fabric member, in equal pressure and fit, so as not to constrict circulation, in particular, in the joint areas, and thereby defeat a main purpose of the invention, tighter fitting garments will also work within the purview of the invention. In either case the goal is to enhance blood circulation and therefore, warmth, in the joint areas, while allowing the muscle areas to cool.

For this purpose, the fabric base member is made of a heat transmitting or transmissive material so that heat can dissipate from the large muscles in the muscle areas of the user's body that are covered by the fabric member 10.

Figure 3:
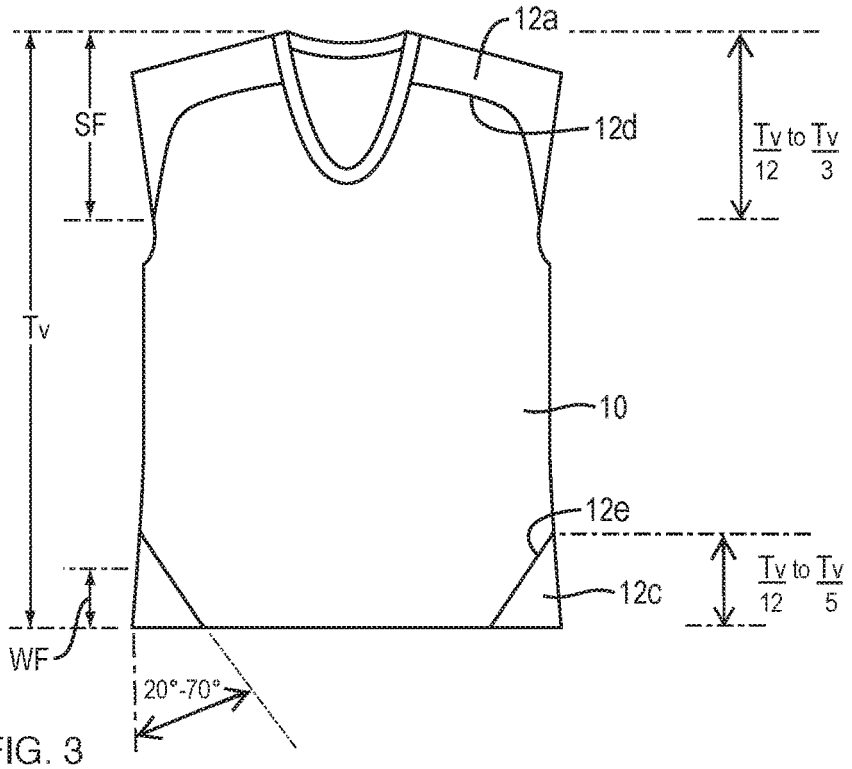
FIG. 3 is a front view of the lady's sleeveless workout or recovery top according to the invention, in an inside-out position which reveals some of the critical heat insulating areas of the invention, such as those at the shoulder ball and socket joints and left and right hip areas.
Figure 4:
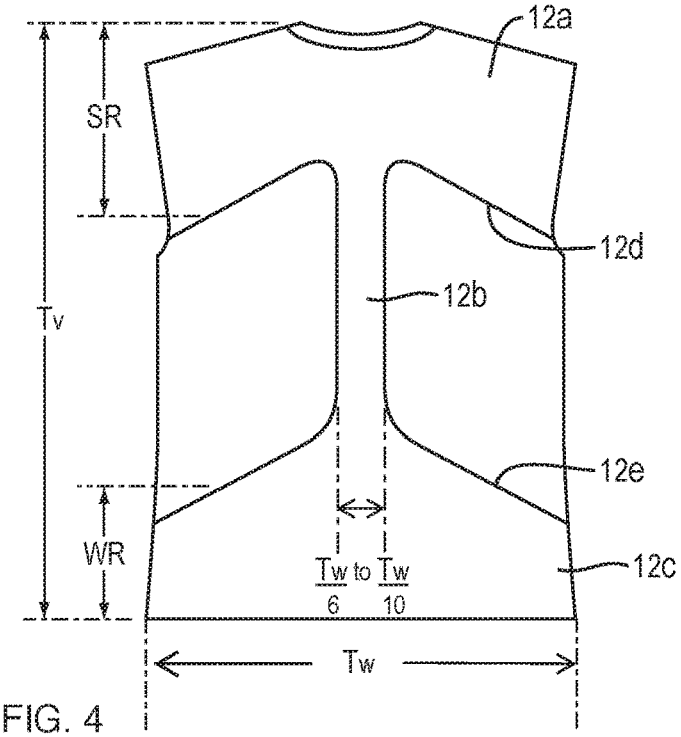
FIG. 4 is a back view of the lady's sleeveless workout or recovery top according to the invention, also in the inside-out position which reveals other parts of the heat insulating areas of the invention, such as those at the shoulder ball and socket joints, left and right hip areas and the spine.
Figure 5:
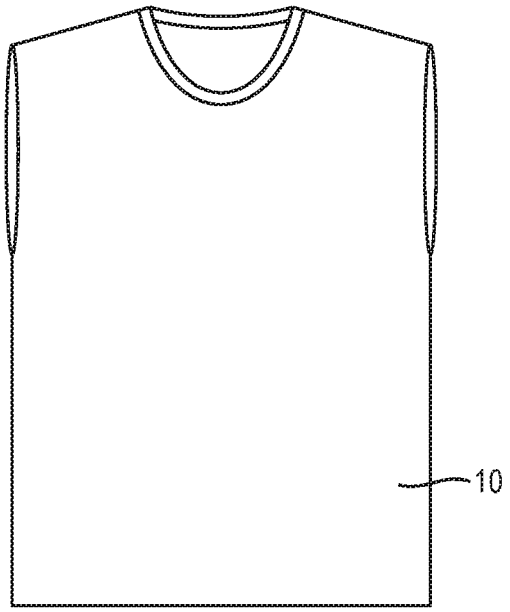
FIG. 5 is a front view of a men's sleeveless workout or recovery top according to the invention, in a right-side-out position, understanding that any fabric can be used on the face of the garment.
Figure 6:
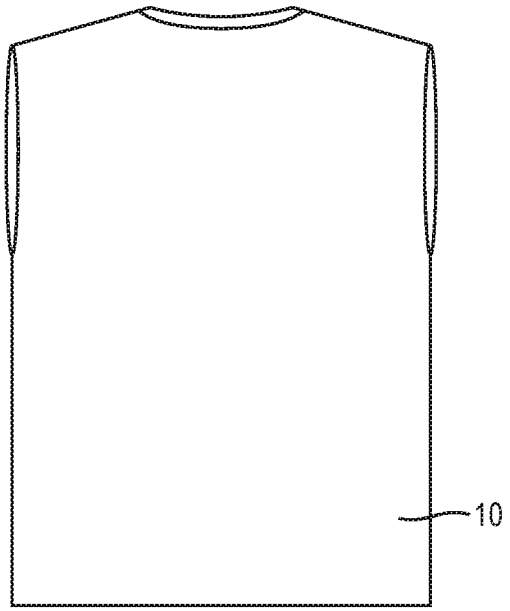
FIG. 6 is a back view of the men's sleeveless workout or recovery top according to the invention, in a right-side-out position.
Figure 7:
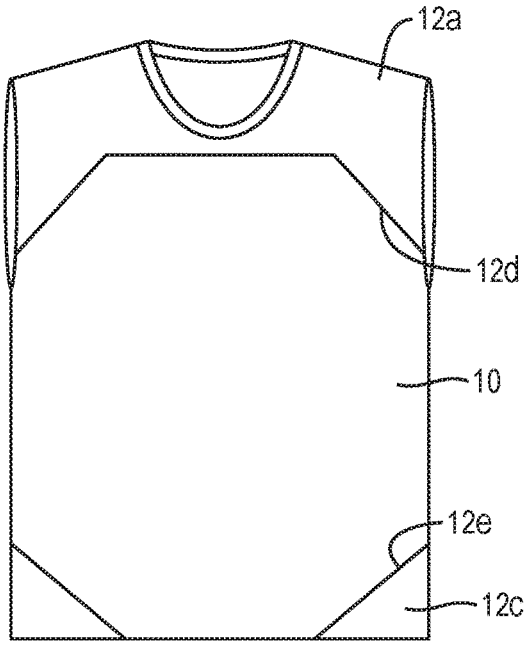
FIG. 7 is a front view of the men's sleeveless workout or recovery top according to the invention, in an inside-out position which reveals some of the heat insulating areas of the invention, such as those at the shoulder ball and socket joints and left and right hip areas.
Figure 8:
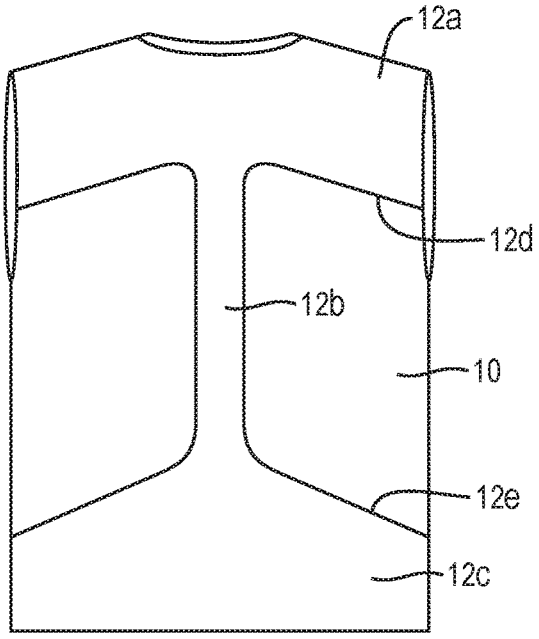
FIG. 8 is a back view of the men's sleeveless workout or recovery top according to the invention, also in the inside-out position which reveals other parts of the heat insulating areas of the invention, such as those at the shoulder ball and socket joints, left and right hip areas and the spine.
Figure 9:
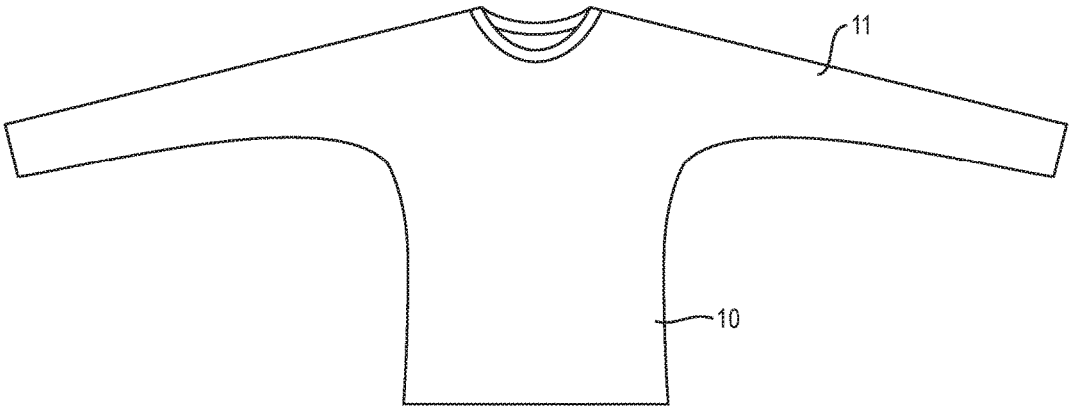
FIG. 9 is a front view of a slim-fit sleeved workout and recovery top according to the invention, in a right-side-out position and of any fabric.
Figure 10:
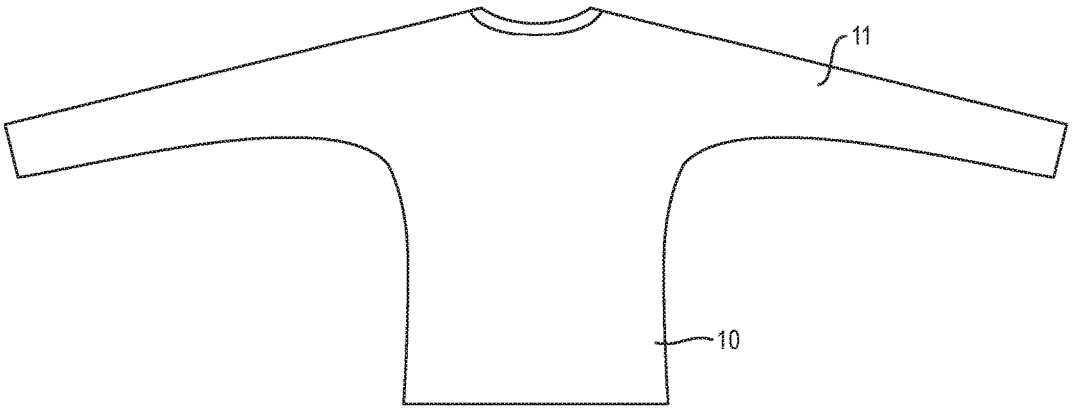
FIG. 10 is a back view of the slim-fit sleeved workout and recovery top according to the invention, in the right-side-out position.

As best shown in FIGS. 3 and 4 revealing the inside surfaces of the garment in front and back views, to enhance circulation in the joint areas, and thereby keep these areas warmer than the muscle areas, the fabric member 10 of the invention is lined by an additional fabric area or portion 12*a* to 12*e*, having heat insulating properties. These additional fabric portions are fixed to the inside surface of the fabric member by fusing, sewing or other means. A preferred method is to use the AIR MESH brand technology (available from Debs Corporation of Japan) to fuse MIYABI brand fabric to the nylon base fabric. The additional fabric is provided at each joint area while the remaining, unlined parts of the fabric member 10 that cover the muscle areas has heat transmitting properties so that when the garment is worn, each joint area stays warmer than each muscle area to boost circulation in each joint area.

For the purpose of this disclosure, the term fabric is used to describe any woven, non-woven, knit or otherwise created flexible sheet material that is appropriate for manufacturing garments.

Instead of being fixed on the inside surface of fabric member 10, the additional insulating fabric portions can be fixed on the outside surface, sandwiched between two layers of fabric 10 or are manufactures as part of the fabric 10, e.g. by knitting or otherwise forming the insulating layer into the fabric 10.

For the garment top of FIGS. 1 to 4, the additional heat insulating fabric 12 includes an upper portion 12*a* that covers both ball joints at the shoulders and a lower portion 12*c* that covers the waist areas around the user's back, and wraps to the front, to triangular areas on either side of the user's high hip area. This heat insulating fabric also includes a central spinal column portion 12*b* that extends alone the user's spinal column to keep that joint area warmer as well.

The upper shoulder portion 12*a* extends down the front of the garment top on both sides of the user's neck opening as shown in FIG. 3, by an average dimension SF of preferably about 1/12th to about 1/3rd of the total vertical dimension T of the top, with the part of portion 12*a* near the user's neck opening being preferably about 1/10th to about 1/8th of T, and the part of portion 12*a* at the user's arms openings being preferably about 1/10th to about 1/8th of T. The fabric portion 12*a* angles down toward the lower edge of the garment along an edge 12*d* on either side of the garment neck opening and toward each arm opening, first at about 10 to about 30 degrees to the horizontal, closer to the neck opening, and then at about 40 to about 100 degrees to the horizontal, closer to the arm openings.

The lower hip portion 12*c* extends up the front of the garment top of FIG. 3, from its lower edge, by a maximum average dimension WF of about 1/12th to about 1/5th of the total vertical dimension T of the top, at the side of the garment, and angles down toward the lower edge of the garment along an edge 12*e* on either side of the garment front, at an angle of about 20 to about 70 degrees to the horizontal and preferable about 40 to about 50 degrees to the horizontal. The preferable average maximum dimension for WF is about 1/10th to about 1/6th of T.

With reference to FIG. 4, the back inside surface of the garment top, the upper shoulder portion 12*a* extends down the back of the garment top on both sides of the user's neck opening by an average dimension SR of about 1/8th to about 1/3rd of the total vertical dimension T. The back part of fabric portion 12*a* angles down toward the lower edge of the garment along an edge 12*d* on either side of the garment neck opening and toward each arm opening, at about 20 to about 60 degrees to the horizontal.

The lower back and lower hip portion 12*c* extends up the front of the garment top of FIG. 4, from its lower edge, preferably by a maximum average dimension WR of about 1/8th to about 1/3th of the total vertical dimension T of the top, at the sides of the garment, and angles down toward the lower edge of the garment along an edge 12*e* on either side of the garment front, at an angle of about 20 to about 70 degrees to the horizontal and preferable about 40 to about 50 degrees. The preferable average maximum dimension for WR is about 1/6th to about 1/4th of T.

The heat insulating back fabric portion of FIG. 4 also include the spinal column portion 12*b* that extends centrally between the upper and lower portions 12*a* and 12*c*, that covers the user's spinal column and has a width of preferably about 1/6th to about 1/10th the total width of the garment top, at a location between the upper and lower portions.

FIGS. 5 to 8 show a garment top of the invention in the form of a men's sleeveless workout and recover top having corresponding heat insulating fabric portions 12*a* to 12*e* as those of FIGS. 1 to 4 with the same ranges of dimensions and angles according to the invention.

Figure 11:
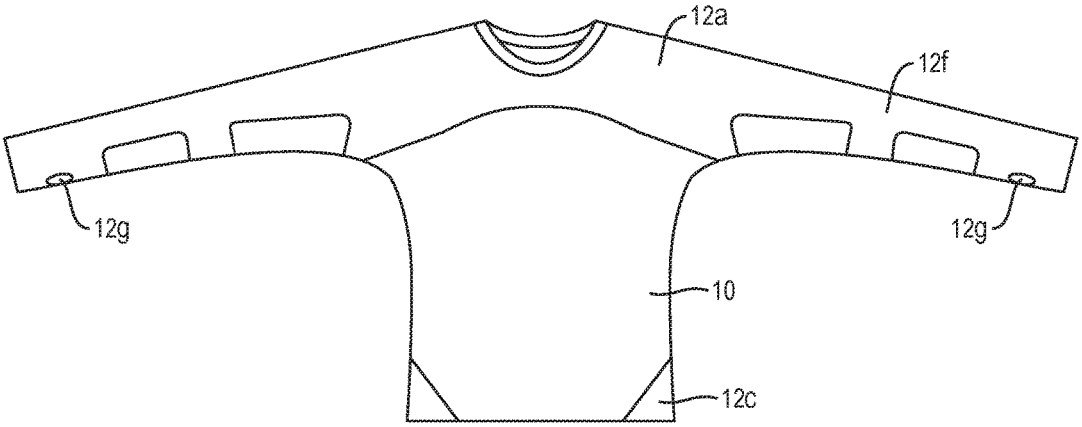
FIG. 11 is a front view of the slim-fit sleeved workout and recovery top according to the invention, in an inside-out position which reveals some of the critical heat insulating areas of the invention, such as those at the shoulder ball and socket joints, the clavicle, the elbows, the wrists, and the left and right hip areas.
Figure 12:
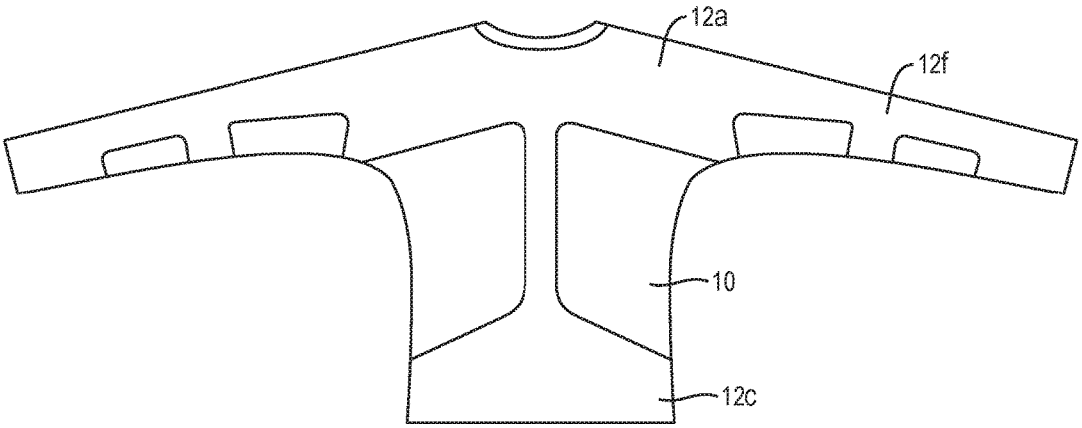
FIG. 12 is a back view of the slim-fit sleeved workout and recovery top according to the invention, also in the inside-out position which reveals other parts of the heat insulating areas of the invention, such as those at the shoulder ball and socket joints, clavicle, elbows, wrists, left and right hip areas, and the spine.
Figure 13:
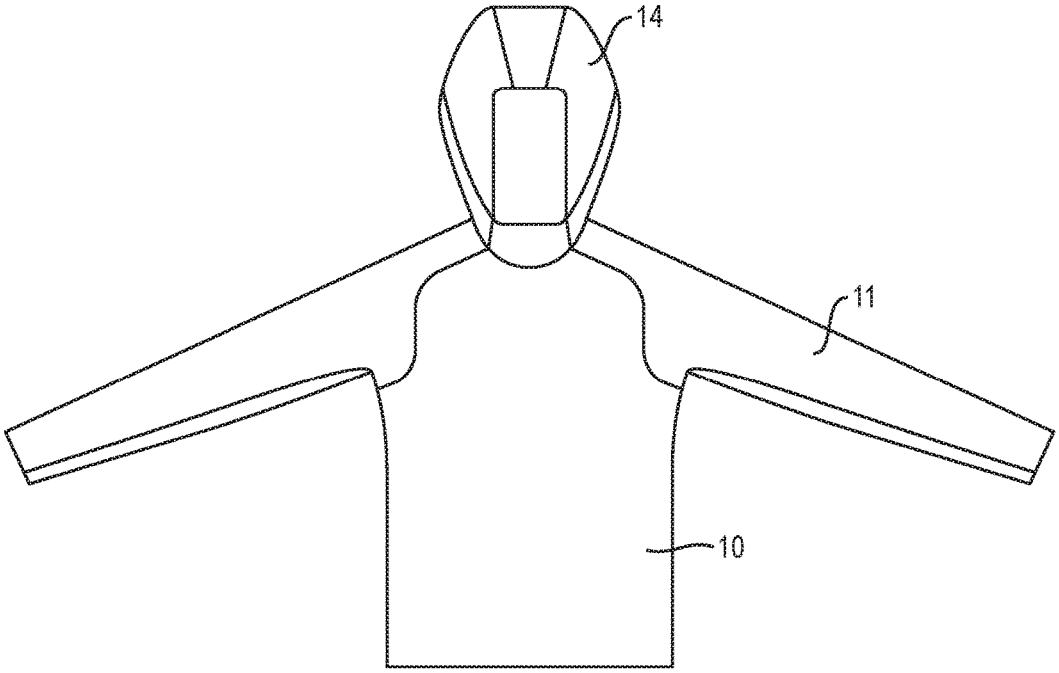
FIG. 13 is a front view of a sleeved and hooded workout and recovery top according to the invention, in a right-side-out position and of any fabric.
Figure 14:
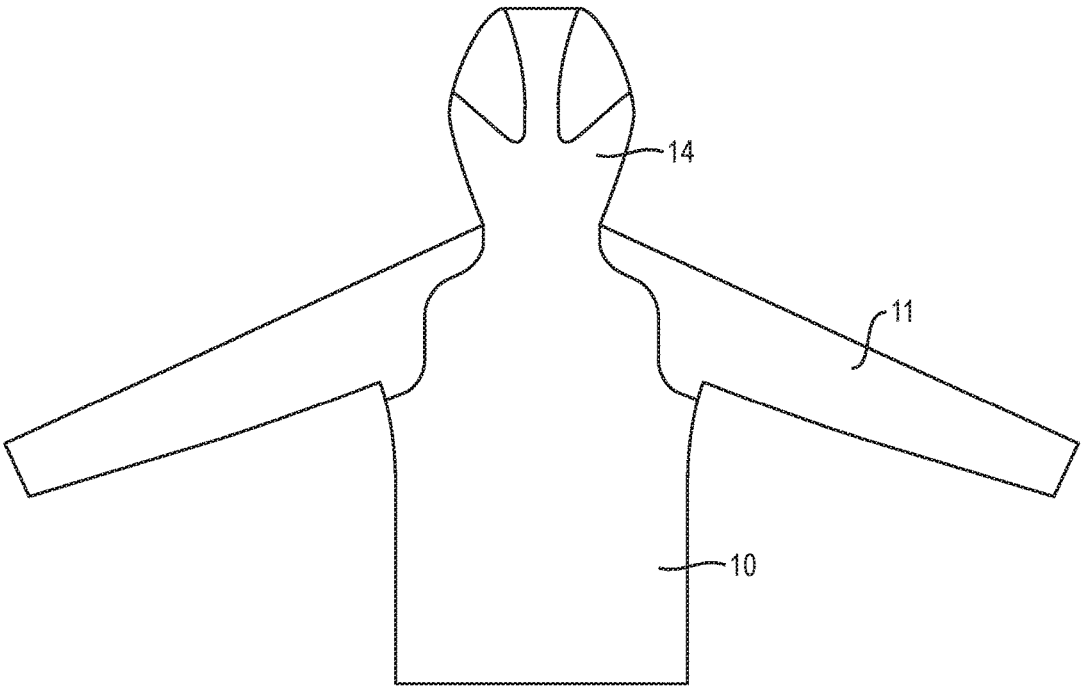
FIG. 14 is a back view of the sleeved and hooded workout and recovery top according to the invention, in a right-side-out position.
Figure 15:
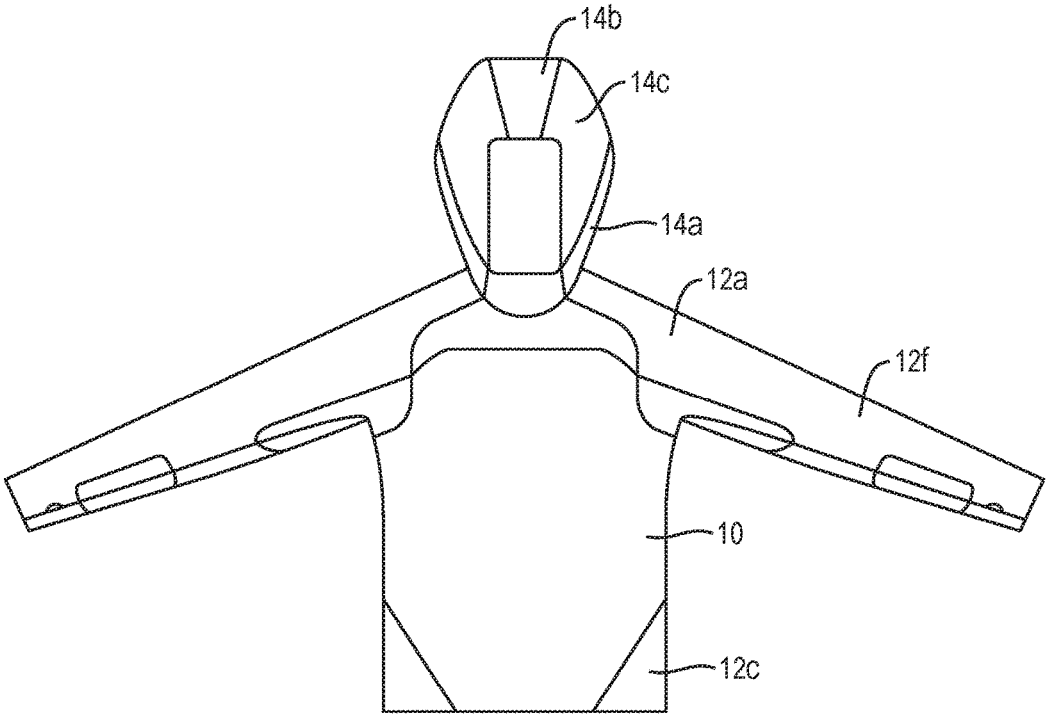
FIG. 15 is a front view of the sleeved and hooded workout and recovery top according to the invention, in an inside-out position which reveals some of the critical heat insulating areas of the invention, such as those at the cranium, the clavicle, the shoulder ball and socket joints, the elbows, the wrists and the left and right hip areas.
Figure 16:
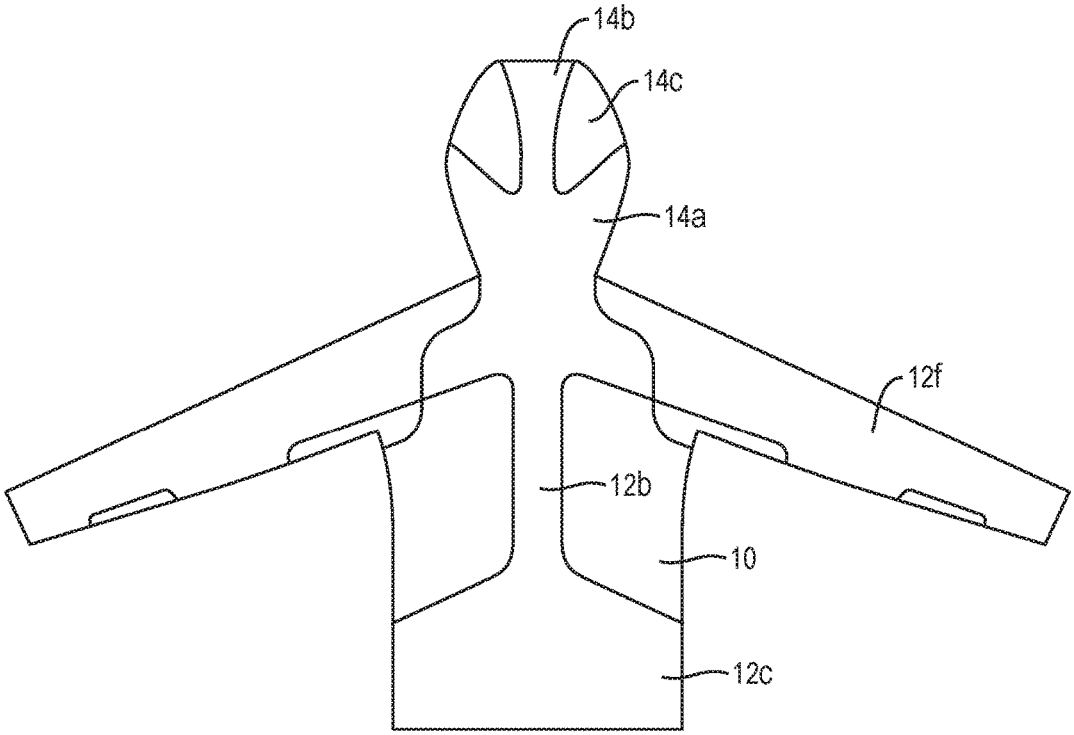
FIG. 16 is a back view of the sleeved and hooded workout and recovery top according to the invention, also in the inside-out position which reveals other parts of the heat insulating areas of the invention, such as those at the cranium, the center of the shoulders, the shoulder ball and socket joints, the elbows, the wrists, the left and right hip areas, and the spine.
Figure 17:
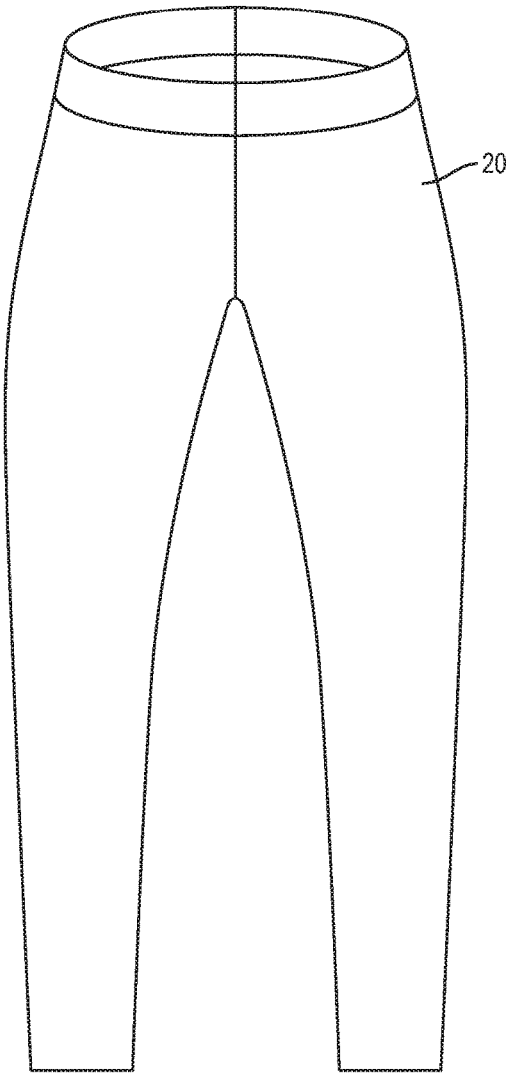
FIG. 17 is a front view of a slim-fit workout and recovery pant according to the invention, in a right-side-out position of any fabric.
Figure 18:
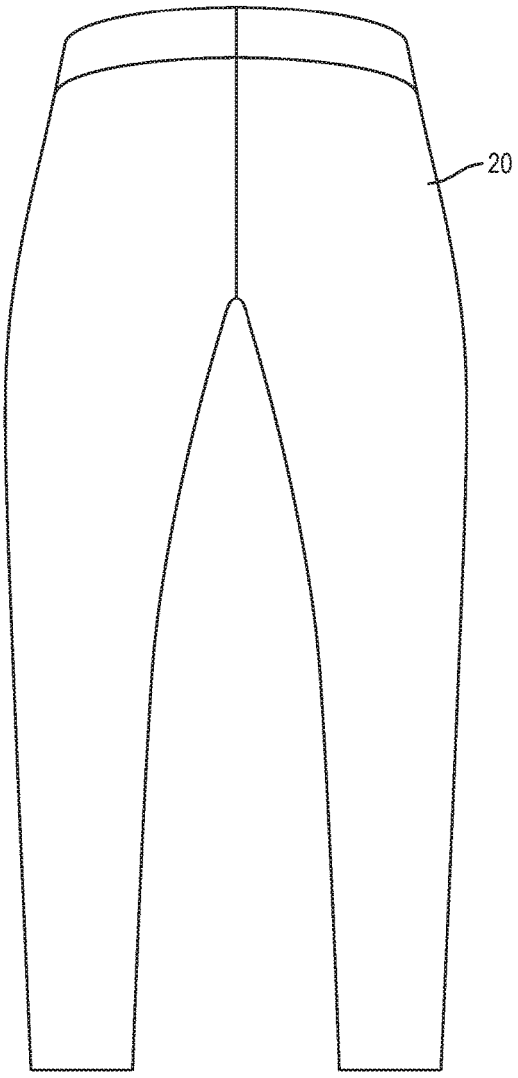
FIG. 18 is a back view of the slim-fit workout and recovery pant according to the invention, in the right-side-out position.
Figure 19:
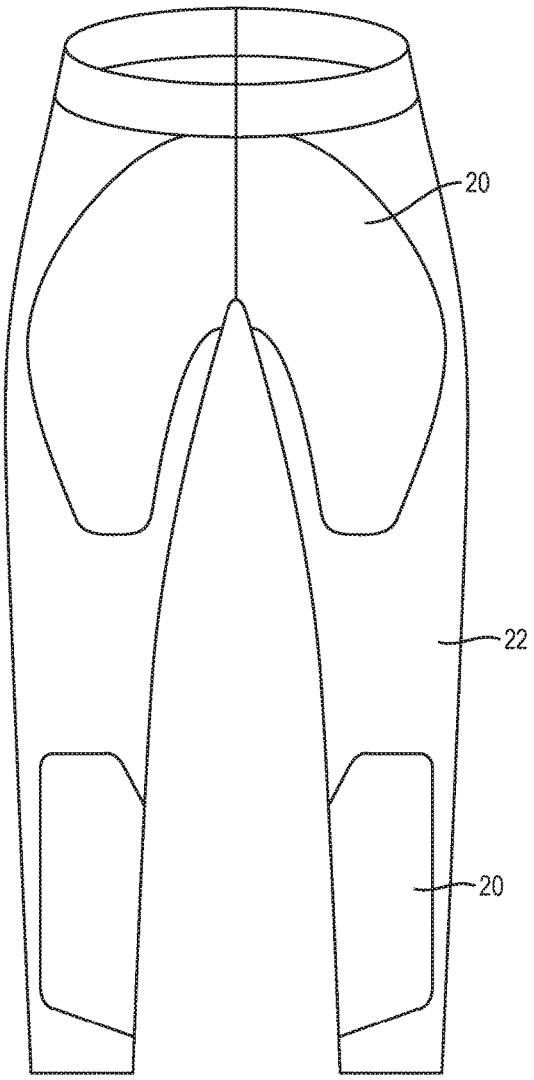
FIG. 19 is a front view of the slim-fit workout and recovery pant according to the invention, in an inside-out position which reveals parts of the heat insulating areas of the invention, such as those at the left and right hip areas, the knee joints and the ankle joints.

FIGS. 9 to 12 show a garment top with sleeves of the invention in the form of a slim-fit sleeved workout and recovery top having corresponding heat insulating fabric portions 12*a* to 12*e* as those of FIGS. 1 to 4 with the same ranges of dimensions and angles according to the invention. This garment also has a pair of sleeves 11, however, with heat insulating material portions 12*f* that cover the entire circumference of the elbow and wrist joints, and the outer parts of the upper and lower arms, leaving the large muscle areas of the inner biceps and forearms covered only by the base fabric of sleeves 11, so as to allow heat to leave these areas. The basic and insulating layers at the ends of the sleeves also include thumb openings 12*g* to the user's thumbs as shown in FIG. 11.

FIGS. 13 to 16 show a garment top with sleeves and a hood of the invention in the form of a workout and recovery top with corresponding heat insulating fabric portions 12*a* to 12*e* as those of FIGS. 1 to 4 with the same ranges of dimensions and angles according to the invention. This garment also has a pair of sleeves 11, however, with heat insulating material portions 12*f* that cover the entire elbow and wrists joints and outer parts of the upper and lower arms, just leaving the muscle areas of the inner biceps and forearms covered by the base fabric of sleeve 11 alone, and a hood 14 of base fabric with side portions 14*a* of heat insulating material to keep the sides of the user's neck warm, and a crown or cranium portion 14*b* to keep the user's cranium warm, while leaving the sides of the user's skill at 14*a* covered only by the base fabric to allow that area to be relatively cooler.

Figure 20:
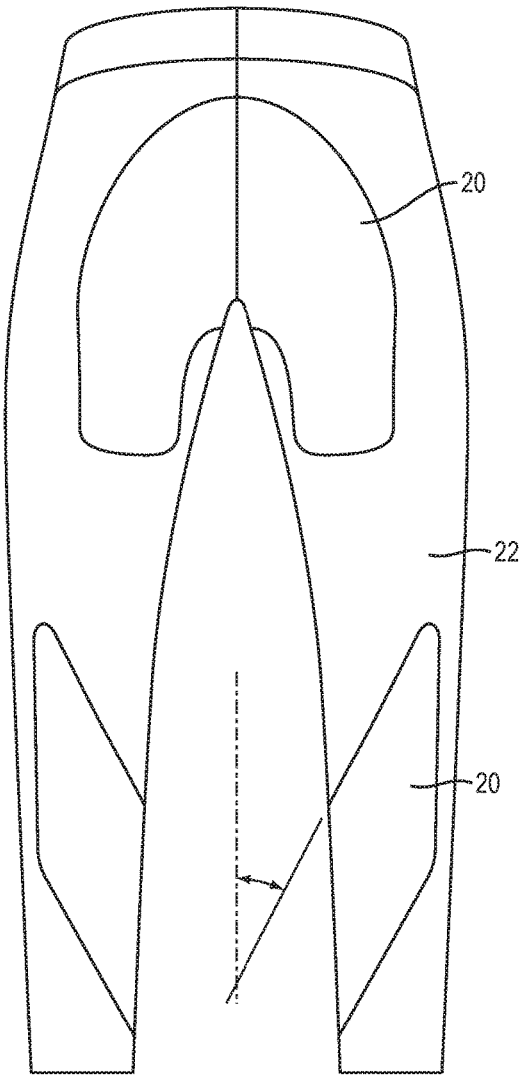
FIG. 20 is a back view of the slim-fit workout and recovery pant according to the invention, also in the inside-out position which reveals other parts of the heat insulating areas of the invention, such as those at the left and right hip areas, the knee joints, the ankle joints and the base of the spine.
Figure 21:
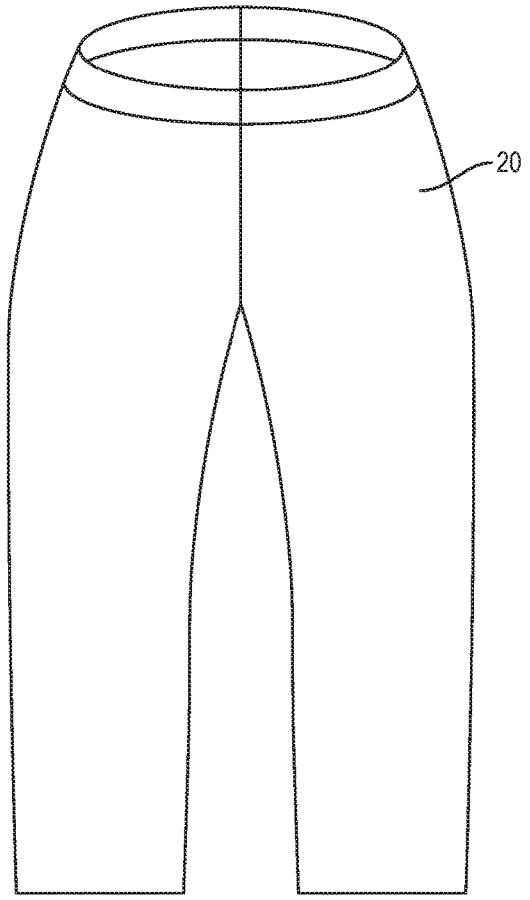
FIG. 21 is a front view of a relaxed-fit workout and recovery pant according to the invention, in the right-side-out position and of any fabric.
Figure 22:
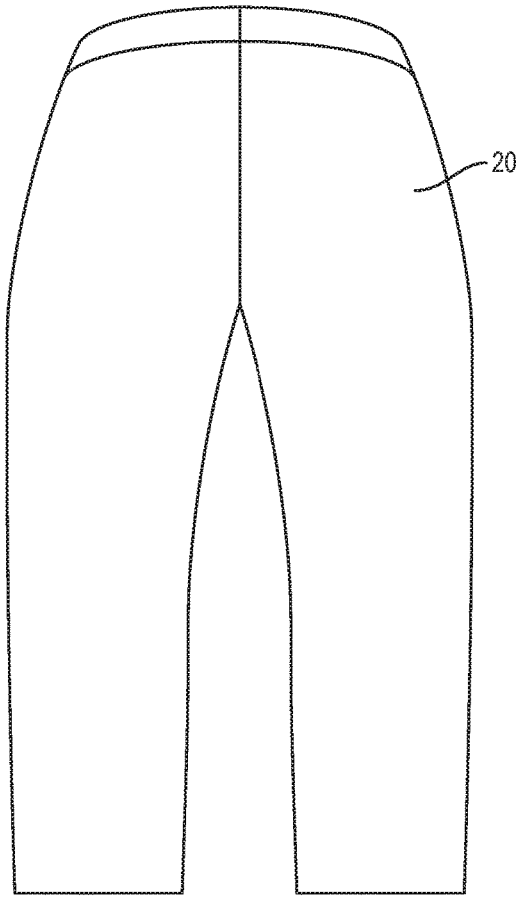
FIG. 22 is a back view of the relaxed-fit workout and recovery pant according to the invention, in the right-side-out position.
Figure 23:
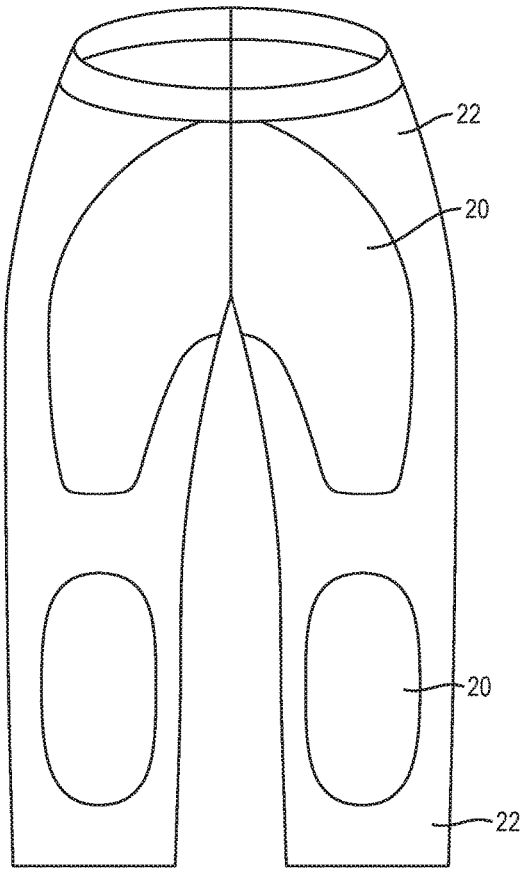
FIG. 23 is a front view of a relaxed-fit workout and recovery pant according to the invention, in an inside-out position which reveals parts of the heat insulating areas of the invention, such as those at the left and right hip areas, the knee joints and the ankle joints.
Figure 24:
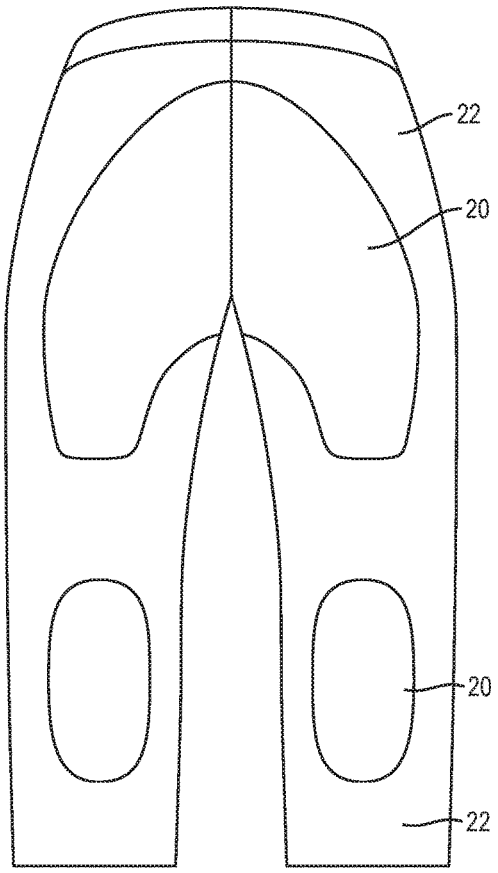
FIG. 24 is a back view of the relaxed-fit workout and recovery pant according to the invention, also in the inside-out position which reveals other parts of the heat insulating areas of the invention, such as those at the left and right hip areas, the knee joints, the ankle joints and the base of the spine.
Figure 25:
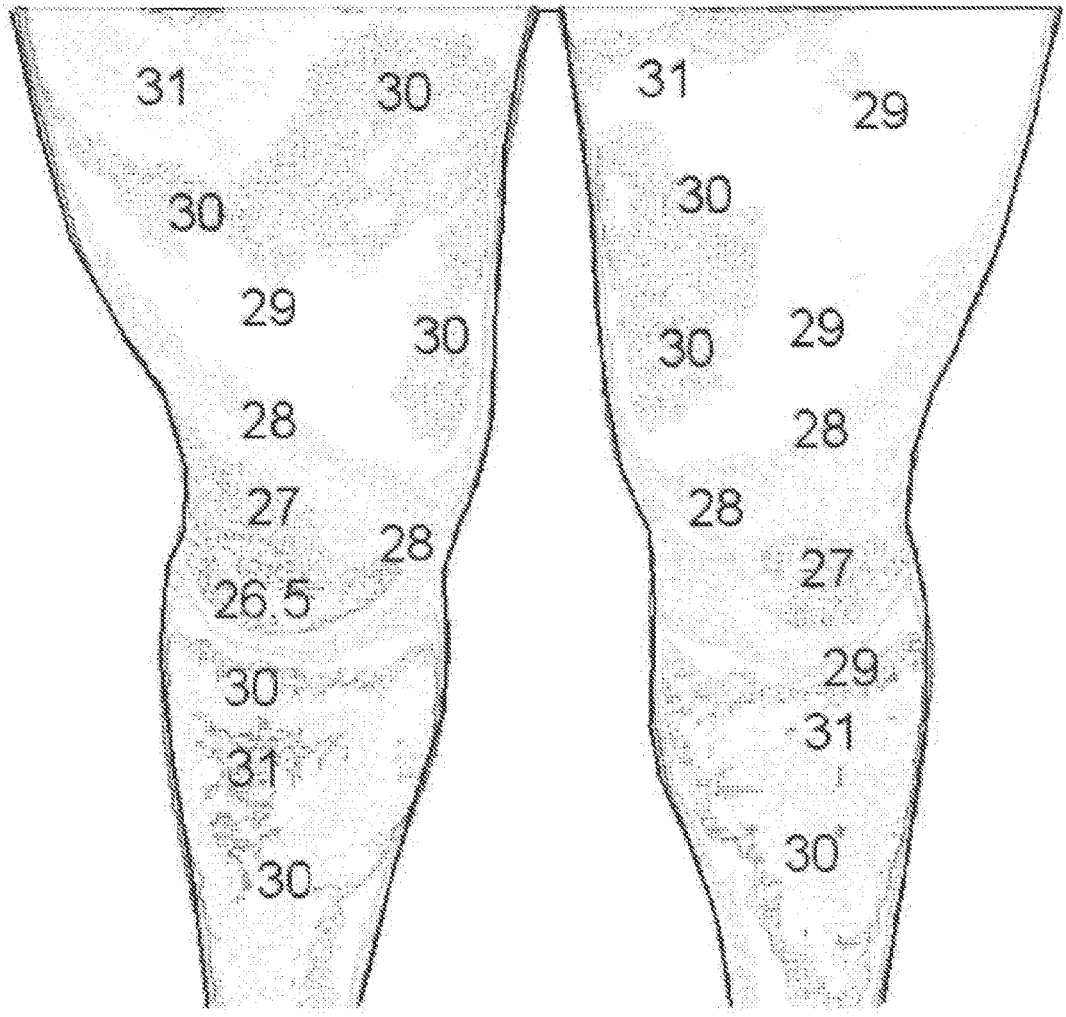
FIG. 25 is a schematic diagram of the legs of a person showing the approximate, normal, at rest temperature of the areas of the legs, including joints areas, namely the knee joints, and muscle areas above and below the knee joints, to illustrate the usual cooler temperatures in the joint areas than those in the muscle areas.

FIGS. 17 to 20 show a garment pant of the invention in the form of a slim-fit workout and recovery pant according to the invention, with base fabric 20 of heat transmitting material that extends over all of the joint and muscle areas, for covering both legs and the low hip of the user, and heat insulating fabric portions 22, fixed to the inside surfaces of the pant for covering the joint areas. The garment pant includes a part for covering the waist, the low hips and legs and the insulating layer 22 of heat insulating material covers the knees, the outer legs, the outer hips and the ankles, leaving uncovered, the gluteus maximus or buttocks, the abdominal muscles or tummy, the quadriceps and back hamstring muscles of the legs above the knees, and the inner, front and back parts of the calves, when the garment is being worn by the user, to allow for cooling of these muscle areas. Insulating layer 22 has upper and lower edges at its back part, that angle downwardly and inwardly of each leg, respectively above and below the user's calves as seen in FIG. 20. This angle is preferably about 20 to 70 degrees from the vertical axis of the pant, or more preferably about 30 to 50 degrees from the vertical.

FIGS. 21 to 24 show a relaxed-fit workout and recovery pant according to the invention, with analogous base and insulated fabric areas 20 and 22.

The apparel or garments of the invention may be in the form of shirts, tunics, tops, pants, shorts, vests, top-plus-pant sets and/or hooded or un-hooded pullovers or jackets, and used as active wear, such as exercise clothing, outer wear, recovery garments, undergarments, for use after an exercise session or for medical recovery, or even specialty clothing such as wet suits.

The base fabric that makes up most or all of the surface of the garment of the invention, in any of its configuration, must be more transmissive of heat than the heat insulating fabric parts to allow the heat to leave the hotter muscle areas. This may be nylon, nylon blends, cotton or other fabric that can be connected to the heat insulating fabric portions by fusing with AIR MESH or the like.

An example of the base fabric used to make the garments of the invention, is a nylon blend of knit 77% nylon threads and 23% polyurethane threads. Any knit or woven fabric with suitable head transmitting properties can be used, however. For active wear the fabric should be knit not woven, however, so there it can stretch but any active wear fabric could be used for the exterior base fabric layer.

An example of heat insulating fabric of the invention for covering, and therefore selectively warming the joint areas of a user, is known by the acronym MIYABI The type of MIYABI fabric found best for the insulating fabric of the invention, since it has the needed stretch, is known as quality #SVQ-50-053 that comes in a width of 62 inches, and has a weight of 160 grams per square meter. The fabric was found to have good heat maintaining, stretch and movement features needed for the purpose of the invention's activewear.

For heat retention it was challenging to find a synthetic yarn that worked best but the following was found to be effective.

Carbon Black Nylon Yarn: is a nylon yarn that is dyed black and the carbon in the fiber maintains a higher temperature. The only limitation was that it can only be offered in the color black.

MIYABI: This is the fiber used for UNIQLO's HEATTECH and Marks & Spencer's HEATGEN items. The only downside is that it is not a synthetic fiber but is a staple fiber like cotton, Rayon, etc.

Another example of the heat insulating fabric is MIYABI Blend: quality #SVQ50-053, 160 gms, 42% MIYABI acrylic 24% polyester 18% viscose 6% pu.

Fusing of the heat insulating material to the heat transmissive fabric base is the technique mentioned above, known by the brand name AIR MESH and available from Debs Corporation of Japan.

For example the MIYABI fabric can be fused to the base fabric Temperature: 160 C to 180 C (320 F to 356 F).

Pressure: 3 to 4 bar; and

Time: 10 to 30 seconds.

These are standard lamination conditions which require a standard laminating facility that is widely available to the trade.

All placements were guided by a general fashion industry standard of placements for clothing all positions will grade based on industry standards for sex and size ¼" to ¾" grade rule would apply for all placements:

HPS—High point shoulder

15" down from high point shoulder is the waist

3" down from waist is high hip

8" down from waist is low hip

8" up from wrist bone is forearm

11" up from wrist bone is the elbow

Shoulder width bone to bone is 15".

These values are based on tendon length start and stop point of coverage and large muscle start and stop coverage the below mock proto types were created in a women's size small—the lines and angles changed to achieve a better balance of coverage.

While specific embodiments of the invention have been shown and described in detail to illustrate the application of the principles of the invention, it will be understood that the invention may be embodied otherwise without departing from such principles.

What is claimed is:

1. A garment for boosting circulation in areas of a user's body corresponding to the user's joints, comprising:

at least one fabric member of a size configured to at least partly cover at least one part of the user's body that includes at least one joint area lying over at least one joint of the user, and at least one muscle area lying over at least one muscle of the user, the at least one fabric member being configured so as not to compress the part of the user's body covered by the at least one fabric member when worn;

the at least one fabric member having a heat insulating property at the at least one joint area to be covered and a heat transmitting property at the at least one muscle area to be covered, so that when the garment is worn, each joint area stays warmer than each muscle area to boost circulation in each joint area, wherein the garment is for covering part of the head, the shoulders, the arms, the waist and the thorax, the at least one fabric member including at least one base layer of heat transmitting material that extends over the at least one joint area and the at least one muscle area, and at least one insulating layer of heat insulating material fixed to the at least one base layer and covering the shoulders, the elbows, the wrists, the outer arms, the sides and back of the waist, the spinal column, the neck, the ears, the cranium and the back of the head, leaving uncovered, the sides and tummy area of the thorax, the inner arms on both sides of the elbows, and the sides of the head below the cranium and above the neck, when the garment is being worn by the user.

2. The garment of claim 1, wherein the at least one fabric member includes at least one base layer of heat transmitting material that is adapted to extend over the at least one joint area and the at least one muscle area, and at least one insulating layer of heat insulating material fixed to the at least one base layer and adapted to extend only over the at least one joint area, the heat transmitting material and the heat insulating material not adapted to compress parts of the user's body covered by the at least one fabric member, and wherein the heat transmitting material consists of at least one material selected from the group of nylon, polyurethane, polyester, cotton and wool, and the heat insulating material consists of at least one material selected from the group of micro acrylic yarn, micro acrylic yarn blended with any other material, and acrylic.

3. The garment of claim 1, wherein the at least one fabric member includes at least one base layer of heat transmitting material that is adapted to extend over the at least one joint area and the at least one muscle area, and at least one insulating layer of heat insulating material fixed to an inside surface of the at least one base layer and adapted to extend only over the at least one joint area, the heat transmitting material and the heat insulating material both being flexible so as not to compress parts of the user's body covered by the at least one fabric member when worn.

4. The garment of claim 1, wherein the at least one fabric member includes at least one base layer of heat transmitting material that is adapted to extend over the at least one joint area and the at least one muscle area, and at least one insulating layer of heat insulating material fixed to an inside surface of the at least one base layer and adapted to extend only over the at least one joint area.

5. The garment of claim 1, wherein the garment is a top, defines a garment neck opening and two arm openings, and includes a shoulder portion of heat insulating material adapted to extend down a front of the top on both sides of the user's neck by 1/12th to 1/3rd of the total vertical length of the top, shoulder portion angling down toward a lower edge of the garment on either side of the garment neck opening and toward each of the two arm openings.

6. The garment of claim 1, wherein the garment is a top, defines a garment neck opening and two arm openings, and includes an upper shoulder portion of heat insulating material adapted to extend down the back of the garment top on both sides of the user's neck by 1/8th to 1/3rd of the total vertical length of the garment, the back part of upper shoulder portion angling down toward a lower edge of the garment along on either side of the garment neck opening and toward each of the two arm openings.

7. The garment of claim 1, wherein the garment is a top, the at least one fabric member including at least one base layer of heat transmitting material that is adapted to extend over the at least one joint area and the at least one muscle area, and at least one insulating layer of heat insulating material fixed to the at least one base layer and adapted to extend only over the at least one joint area, the at least one insulating layer having a back fabric portion including a spinal column portion that extends centrally between upper and lower portions of the at least one insulating layer and that adapted to cover the user's spinal column and has a width of 1/6th to 1/10th of the total width of the garment top, at a location between upper and lower portions of the at least one insulating layer.

8. A garment for boosting circulation in areas of a user's body corresponding to the user's joints, comprising:

at least one fabric member of a size configured to at least partly cover at least one part of the user's body that includes at least one joint area lying over at least one joint of the user, and at least one muscle area lying over at least one muscle of the user, the at least one fabric member being configured so as not to compress the part of the user's body covered by the at least one fabric member when worn;

the at least one fabric member having a heat insulating property at the at least one joint area to be covered and a heat transmitting property at the at least one muscle area to be covered, so that when the garment is worn, each joint area stays warmer than each muscle area to boost circulation in each joint area, wherein the garment is a top and includes a waist portion of heat insulating material extending up a front of the top from a lower edge thereof by 1/12th to 1/5th of the total vertical length of the top, on either side of a front of the garment, at an angle of 20 to 70 degrees to the horizontal, the heat insulating material covering the shoulders, the elbows, the wrists, the outer arms, the sides and back of the waist, the spinal column, the neck, the ears, the cranium and the back of the head, leaving uncovered, the sides and tummy area of the thorax, the inner arms on both sides of the elbows, and the sides of the head below the cranium and above the neck, when the garment is being worn by the user.

* * * * *